United States Patent [19]

Crawford

[11] 4,012,999

[45] Mar. 22, 1977

[54] APPARATUS FOR FORMING TRAYS

[75] Inventor: Lynn D. Crawford, San Jose, Calif.

[73] Assignees: Genevieve I. Hanscom; Genevieve I. Hanscom, Robert M. Magnuson and Lois J. Thomson, Trustees of the Estate of Roy M. Magnuson, all of Calif. ; part interest to each

[22] Filed: Sept. 17, 1975

[21] Appl. No.: 614,433

[52] U.S. Cl. ..... 93/51.1; 93/44.1 R; 93/59 ES

[51] Int. Cl.[2] ..... B31B 1/44

[58] Field of Search ..... 93/51.1, 51 R, 44, 44.1 R, 93/59 ES, 12 R, 49 R

[56] References Cited

UNITED STATES PATENTS

| | | | |
|---|---|---|---|
| 2,077,913 | 4/1937 | Waters | 93/51.1 X |
| 2,110,368 | 3/1938 | Lautzenheiser | 93/51 R |
| 2,135,409 | 11/1938 | Munn et al. | 93/51.1 X |
| 2,412,369 | 12/1946 | Tascher | 93/51.1 |
| 2,851,836 | 9/1958 | Fromwiller | 93/51 R |
| 2,993,419 | 7/1961 | Currie | 93/59 ES X |
| 3,648,573 | 3/1972 | LeFebvre et al. | 93/59 ES X |

*Primary Examiner*—James F. Coan
*Attorney, Agent, or Firm*—Gerald L. Moore

[57] ABSTRACT

Apparatus and method of forming a tray which includes a bottom panel, four upstanding side panels and corner gussets for sealing and holding the bottom panel end flaps and side flaps in the formed position including means for receiving a stack of precut blanks from which the tray is formed, feeding one at a time, the blanks through a glue station for the deposition of a predetermined glue pattern on the corner gussets, and thereafter folding the blank into a tray in a die and mandrel wherein in successive steps the end flaps are folded, the corner gussets are influenced inward and the side flaps are folded to complete the tray. The die and mandrel assembly serves to hold the tray momentarily after formation to permit the glue to adhere and thereafter functions to strip the tray from the mandrel and hold it in a position satisfactory for removal from the assembly.

11 Claims, 25 Drawing Figures

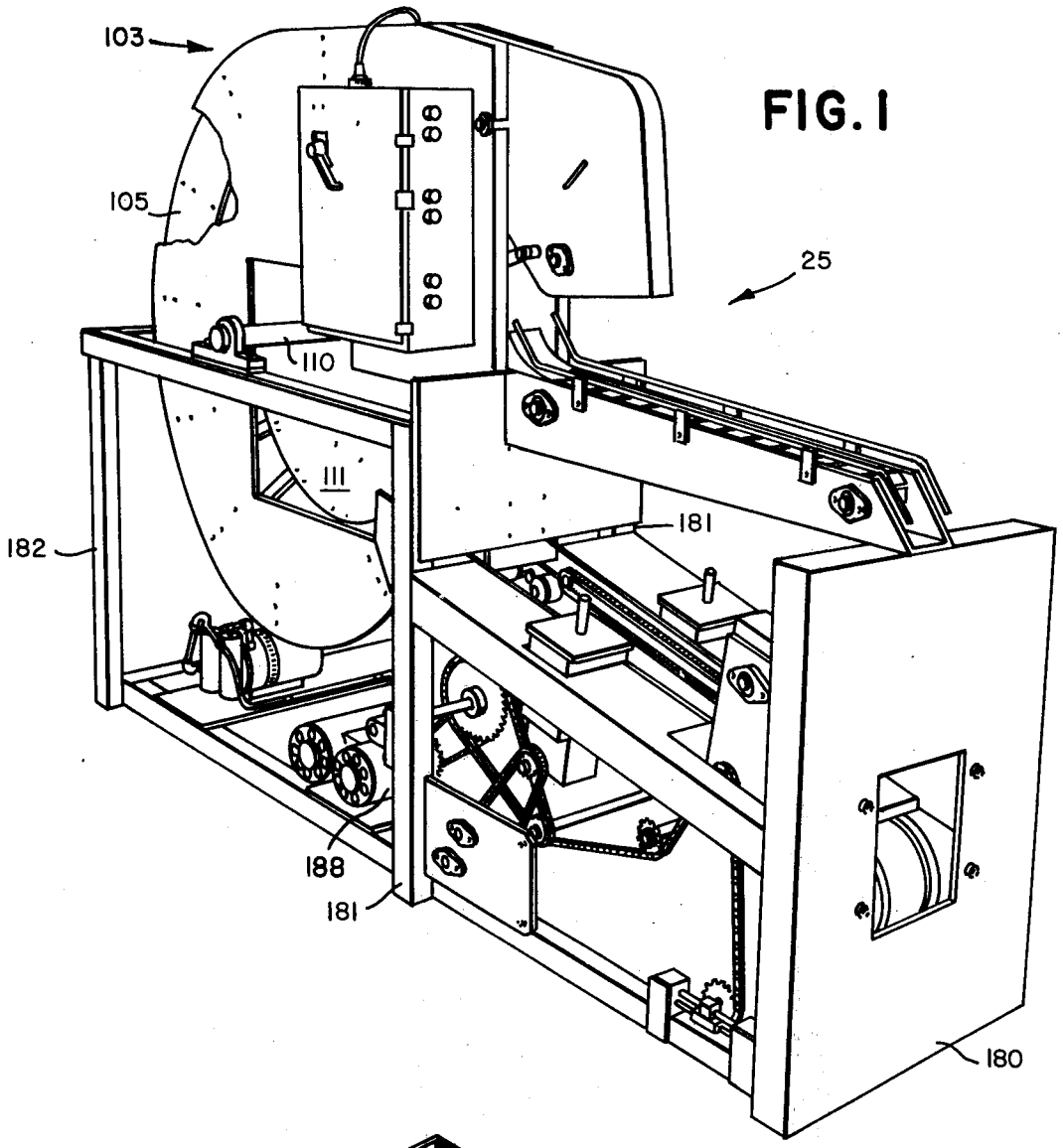
FIG. 1
FIG. 2
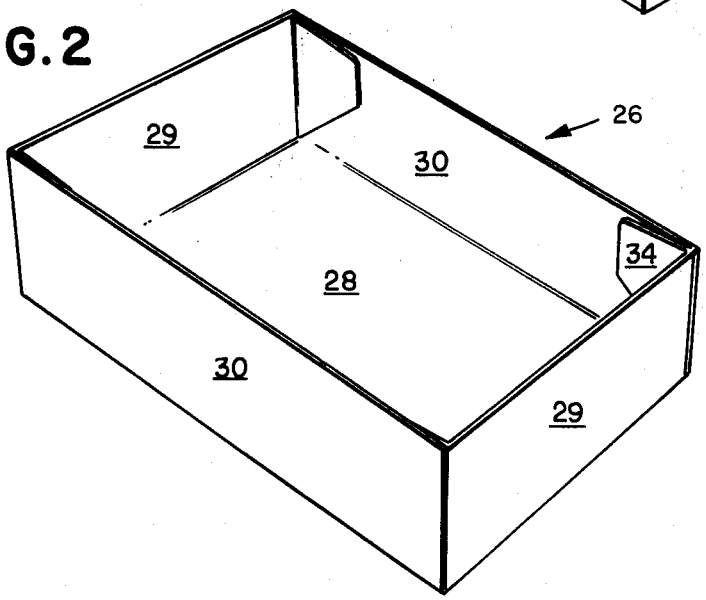

FIG. 8
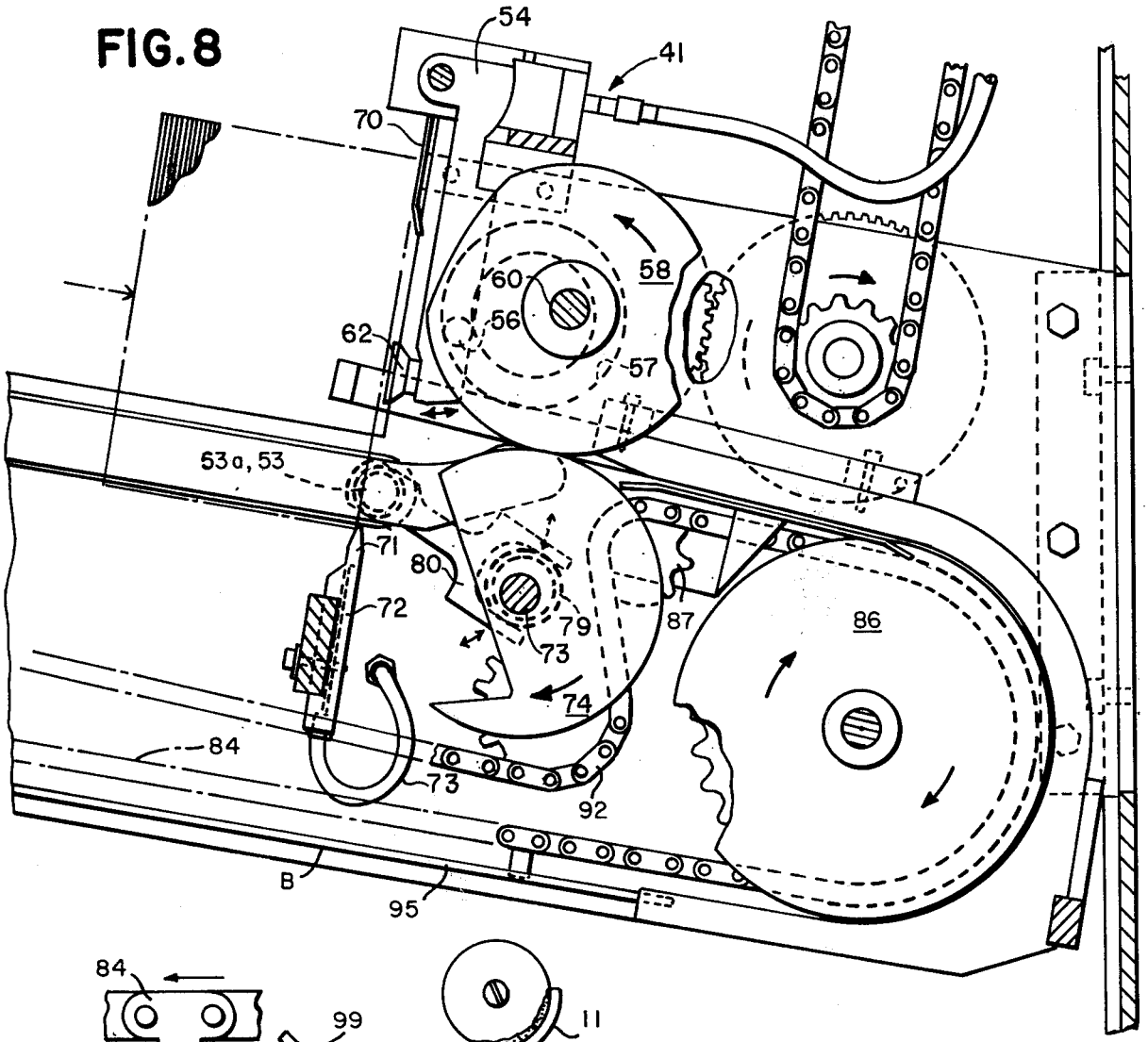
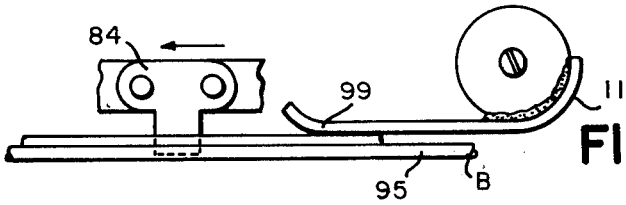
FIG. 12
FIG. 11
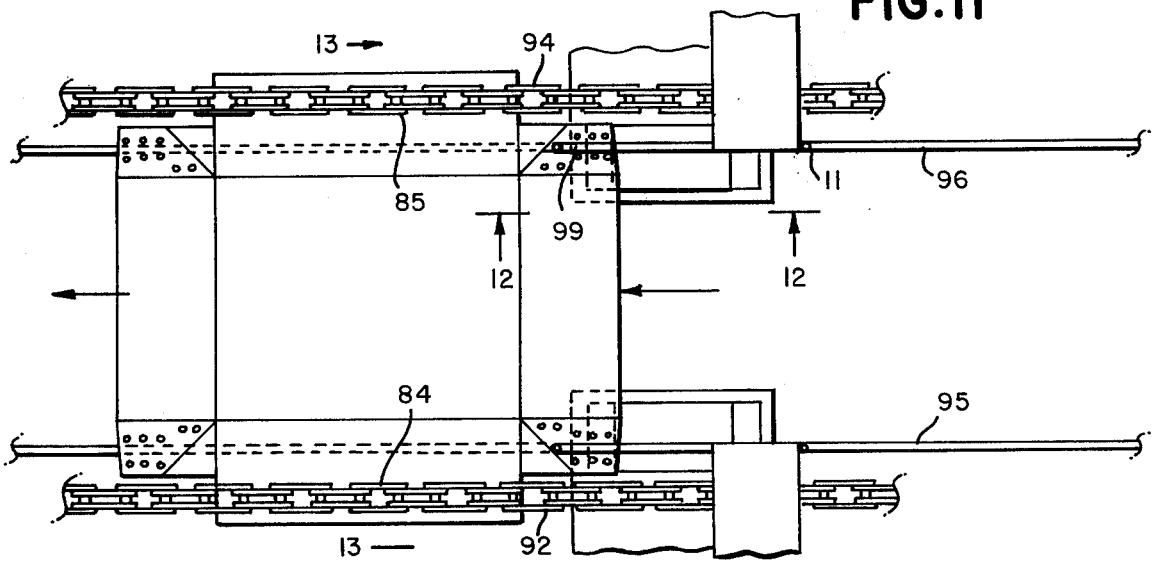

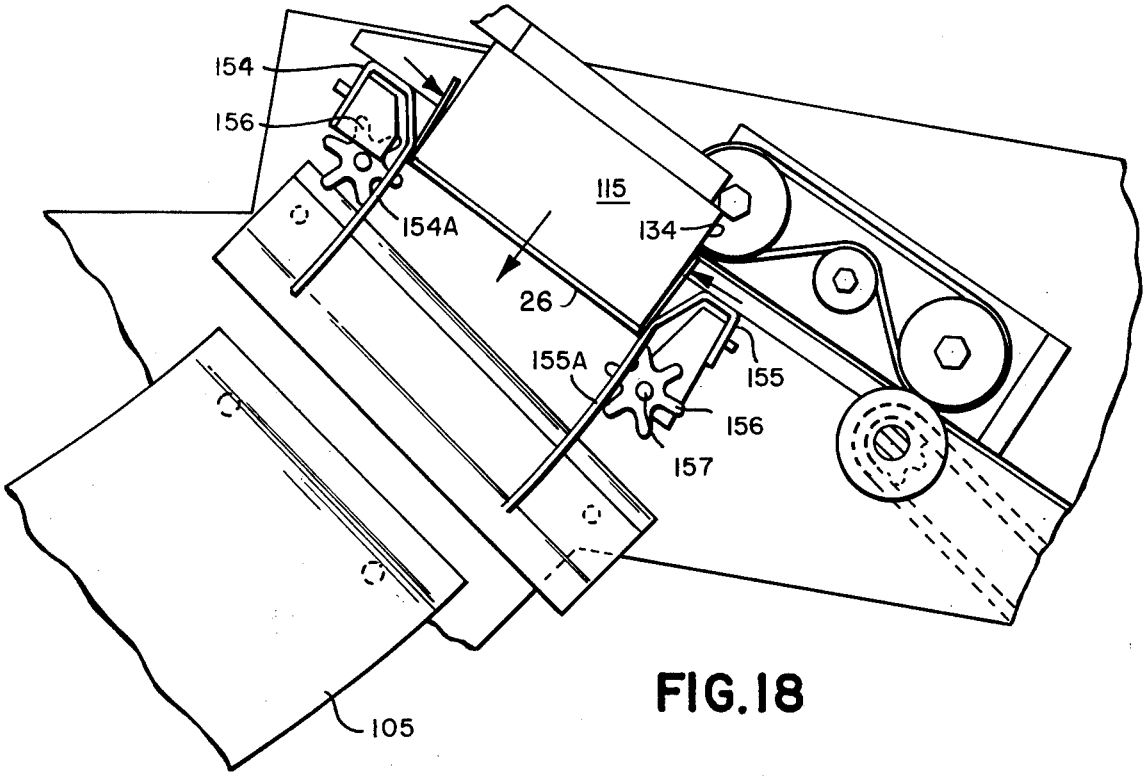
FIG. 18
FIG. 21
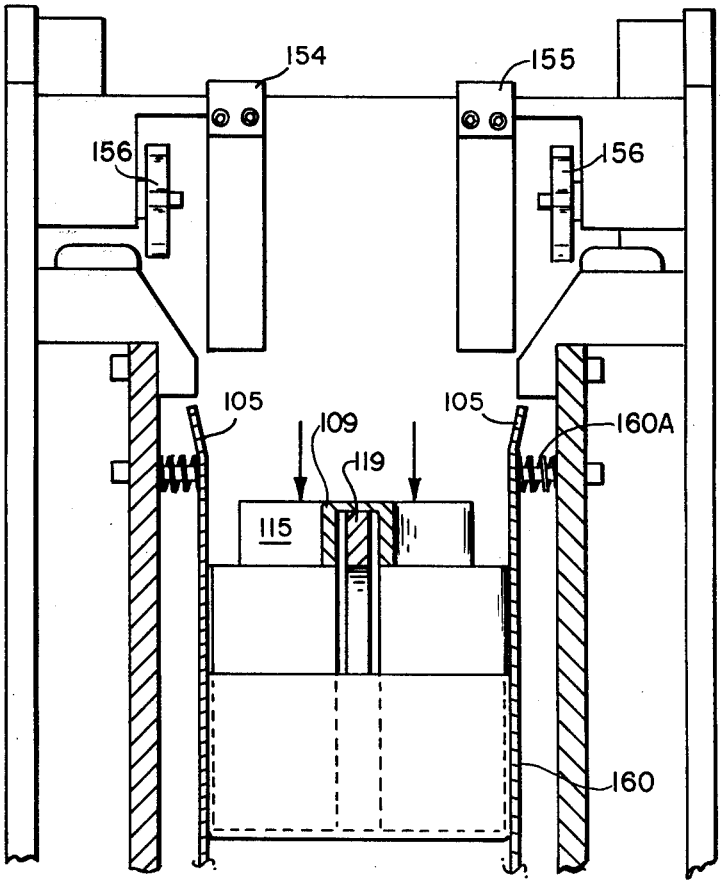

APPARATUS FOR FORMING TRAYS

CROSS-REFERENCE TO RELATED APPLICATIONS

Application Ser. No. 614,352, filed Sept. 17, 1975, now abandoned, entitled TRAY BLANK FEEDER, Ralph K. Dougherty.

Application Ser. No. 614,336, filed Sept. 17, 1975, entitled DEVICE FOR ACCELERATING AND TIMING ARTICLES, Lynn D. Crawford and Ralph K. Dougherty.

Application Ser. No. 614,351, filed Sept. 17, 1975, entitled CARTON SEALING APPARATUS, Lynn D. Crawford.

BACKGROUND OF THE INVENTION

The present invention is involved with the forming of a tray suitable for use in packaging foodstuffs and specifically suitable for packaging frozen foodstuffs.

In general there are currently used two basic types of cartons for packaging frozen foods. One type utilizes a lid and tray formed from a single blank and attached together along one edge. The tray and lid can be locked and sealed by interlocking parts or by the use of glue. Difficulties have arisen in handling such a carton in that the lid is always attached and therefore the operations of forming the tray and filling the tray are more complicated due to the free-swinging lid. In addition, in the case of the interlocking parts there is some chance that the interlock will fail permitting the carton to come apart. The advantage of using such a tray is that foodstuffs can be inserted easily into the large flat open-topped tray. In addition, where the tray is more or less watertight, liquid foodstuffs can also be packed.

The other type of carton used today is the tubular type wherein the carton is formed with both ends open usually with a glue joint running lengthwise of the carton. End flaps are formed integral with the body portion and by closing one end, foodstuffs can be packed into the other end prior to closing. The disadvantage of this type of carton is that certain foodstuffs cannot be efficiently packed therein from one open end. For instance, asparagus or other foodstuffs packed in a parallel manner cannot be inserted through one end of the carton. Therefore these cartons will accept free-flowing products but will not accept such products as asparagus, broccoli, cauliflower, et cetera.

The present invention makes use of the advantages of a carton which incorporates a tray which is waterproof and can be easily packed with foodstuffs. The carton involves a separated tray and lid providing the advantages of ease of handling since only the tray is passed through the packing station and thereafter the lid is brought into engagement with and fixed to the tray. Because of the particular configuration of the lid and tray an overwrap can be done away with and the label printed directly on the lid and tray.

The apparatus embodying the present invention is directed to the forming of such cartons and trays made from such materials as paper, cardboard, plastic or like materials. Ordinarily where such trays are used in industries such as food packaging, the tray blanks are delivered to the place of usage and formed just prior to the timing of filling. In other words, if food products are being packaged, the forming apparatus is positioned adjacent the filling machinery so that the trays are delivered directly from the forming apparatus to the filling station.

The reason for forming the trays immediately prior to use primarily involves the difficulty in storing and handling the tray once it is formed. Whereas the blank material stacks and stores easily and efficiently, the formed tray or carton does not. In addition, if the trays become flattened or otherwise deformed during transportation or storage, the subsequent filling machines might not handle them properly.

With the apparatus being located at the filling station, other factors become quite important. For instance, preferably the forming apparatus should be compact so as not to take up space which otherwise can be used for other purposes. In addition, with the high cost of such machinery and labor, it is increasingly important that the throughput be as high as practical. This reduces the number of tray forming machines necessary which both reduces the initial capital investment, the manpower needed for operation of the machinery and the space necessary to accommodate the tray forming.

Because of requirements for many different sizes of trays, it is also important to provide forming apparatus which is adaptable for handling various sizes of blanks and formed trays. Thus if one need only change the mandrels and adjust the other guide widths, et cetera, to change the size of the trays handled within the limits of the handling capabilities of such apparatus, the capital investment is reduced by requiring fewer machines for a given installation. For instance, in food processing where the products can be seasonal and can require different size trays, it is very economical to utilize the same tray-forming apparatus for different forming operations.

In accordance with the foregoing, it is the primary purpose of this invention to provide an improved apparatus for the formation of trays or cartons from blank material.

DESCRIPTION OF THE DRAWINGS

FIG. 1 is a perspective view of the tray-forming apparatus.

FIG. 2 is a perspective view of the formed tray.

FIG. 8 is a side plan view partially cut away of the blank feeding mechanism.

FIG. 11 is a top plan view of the blank conveying mechanisn.

FIG. 12 is a partial view of the blank in the tray forming station.

FIGS. 18, 19, 20 and 21 show various steps of folding the tray blank to form the tray.

DESCRIPTION OF THE INVENTION

Figure 3:
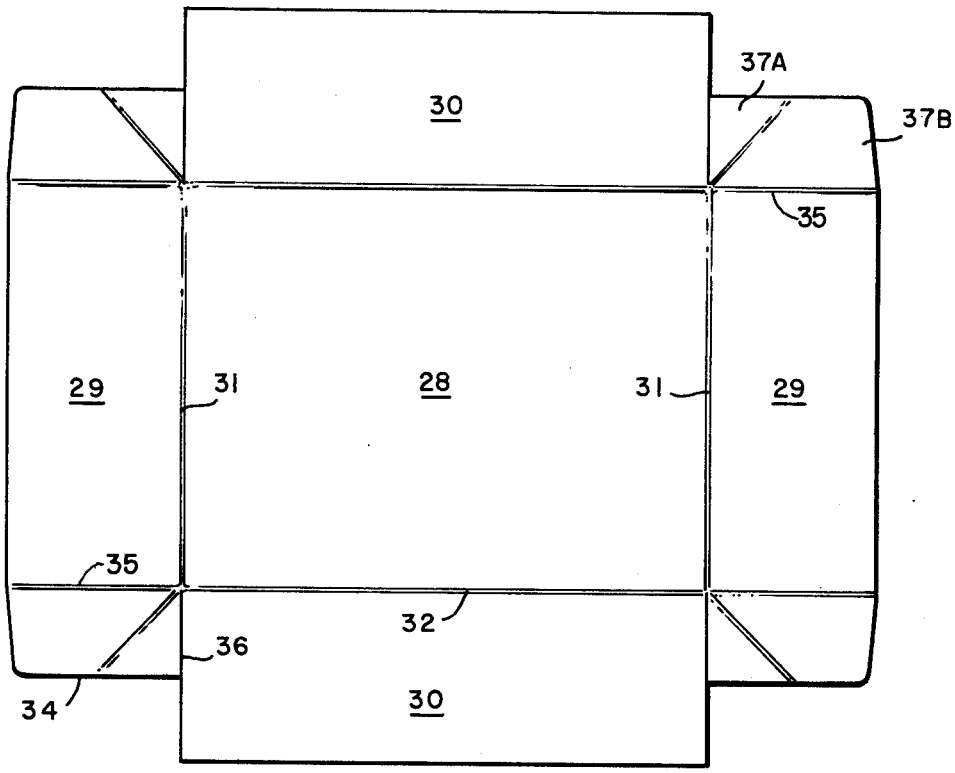
FIG. 3 is a plan view of the tray blank.

In FIG. 1 is shown the apparatus 25 embodying the subject invention for the purpose of forming such containers as the tray 26 shown in FIG. 2. Such a tray is formed from the blank 27 shown in FIG. 3. This blank comprises a bottom panel 28, end flaps 29 and side flaps 30 fixed to opposite edges of the bottom panel. The end flaps are connected to the bottom panel at a fold line 31 and the side flaps are connected at the fold line 32. Corner gussets 34 are located at the corners of the bottom panel and connecting each adjacent side flap and end flap. The corner gussets are connected to the end flap at the fold line 35 and to the side flap at the fold line 36.

Figure 4:
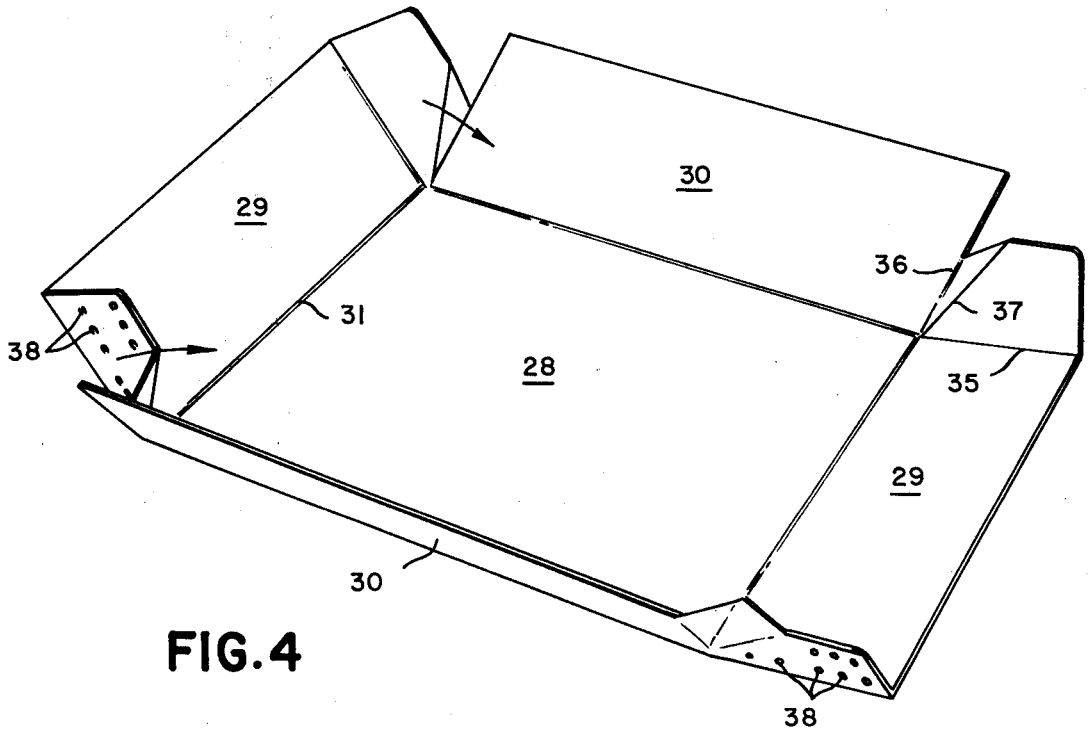
FIG. 4 shows the blank partially folded to form the tray.

As shown in FIG. 4, the tray is formed by folding the end and side flaps to one side of and to a position extending perpendicular to the bottom panel. The corner sections 37A and 37B (FIG. 3) of the corner gusset lay flat against each other and against the side flap 30 as shown in FIG. 2. A pattern 38 of molten glue (see FIG. 4) on the sections of the corner gussets holds the tray in the formed configuration. In the manner just described there is formed from a single blank a tray which because of the corner gussets, is well-sealed at the corners and has a rigid construction especially suitable for holding foodstuffs such as frozen foods.

Figure 6:
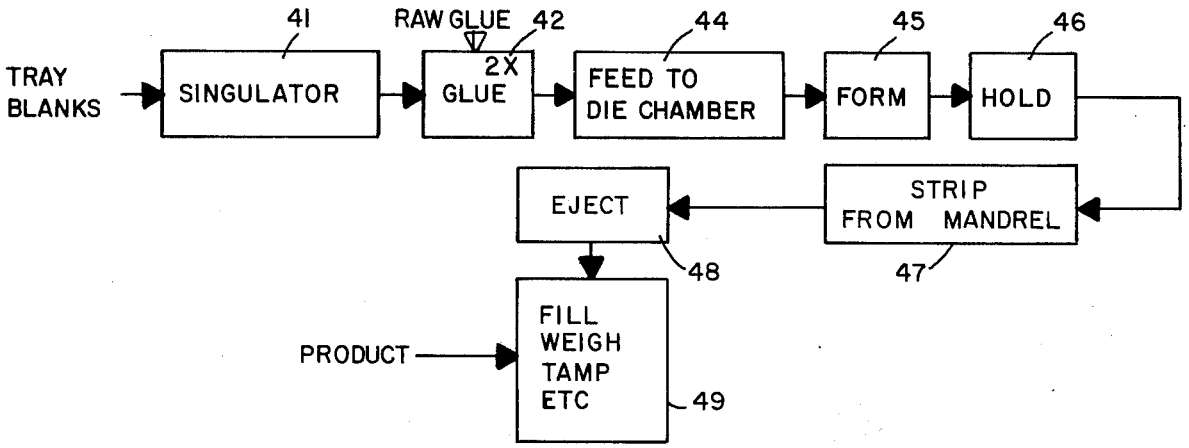
FIG. 6 is a block diagram showing the various steps for forming the tray.

Referring now to FIG. 6, therein is shown in block diagram form the steps necessary for forming the subject tray. The tray blanks are placed in a stack onto the blank feeding mechanism 41 which in turn feeds them singularly to a conveyor. Thereafter the trays are passed through a glue station 42 which deposits glue in a predetermined pattern on the corner gussets. The tray blank is then fed to a die chamber 44 for passage through a forming station 45 and a holding station 46 which folds and maintains the tray in the formed attitude for a time sufficient for the glue to adhere.

The tray is stripped from the mandrel at a station 47 and passed through an outfeed station 48 for depositing external to the forming apparatus. As pointed out before, it is preferable that the forming of the tray be accomplished near the point of actual use and to exemplify this circumstance, a filling stage 49 is shown wherein product is placed into the tray, the tray is weighed and tamped, if applicable, and ultimately sealed.

Figure 5:
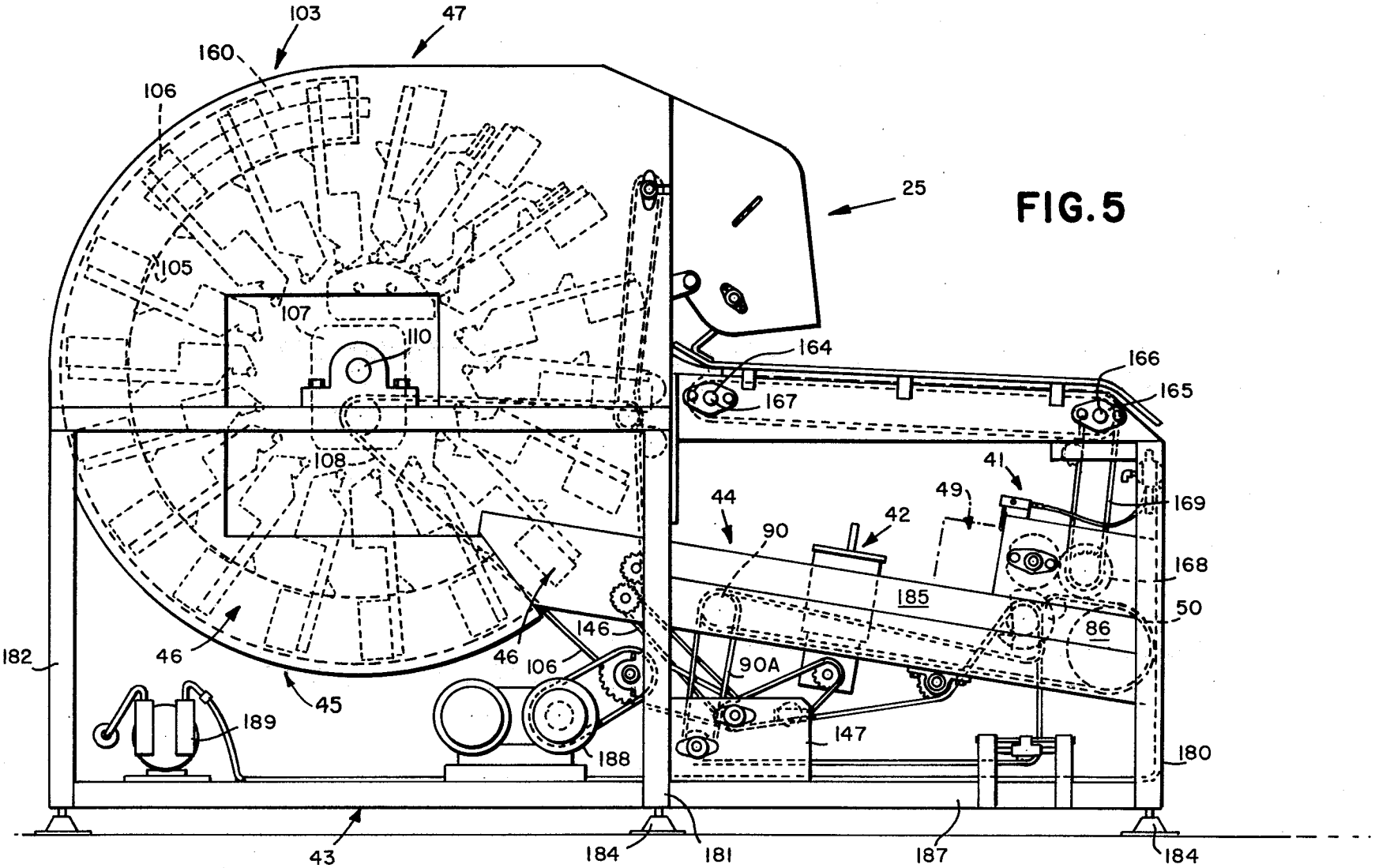
FIG. 5 is a side plan view of the tray forming apparatus.

In accordance with the present invention, the foregoing steps are achieved for the formation of the tray in the manner previously described in an improved apparatus 25 which is both compact in size and operates at speeds exceeding those normally encountered in present-day tray-forming machines. The forming apparatus 25 as shown in FIG. 5 includes the blank-feeding station 41, a gluing station 42, a conveyor feed 44, a forming station 45, a holding station 46, a stripping station 47 and an outfeed station 48 all built into a main frame 43. Thus a stack of tray blanks 49 is supplied to the apparatus from which individual blanks are stripped and fed to a conveyor 50 for transporting through the glue station 42 to thereafter be conveyed to the die and mandrel forming station.

Figure 7:
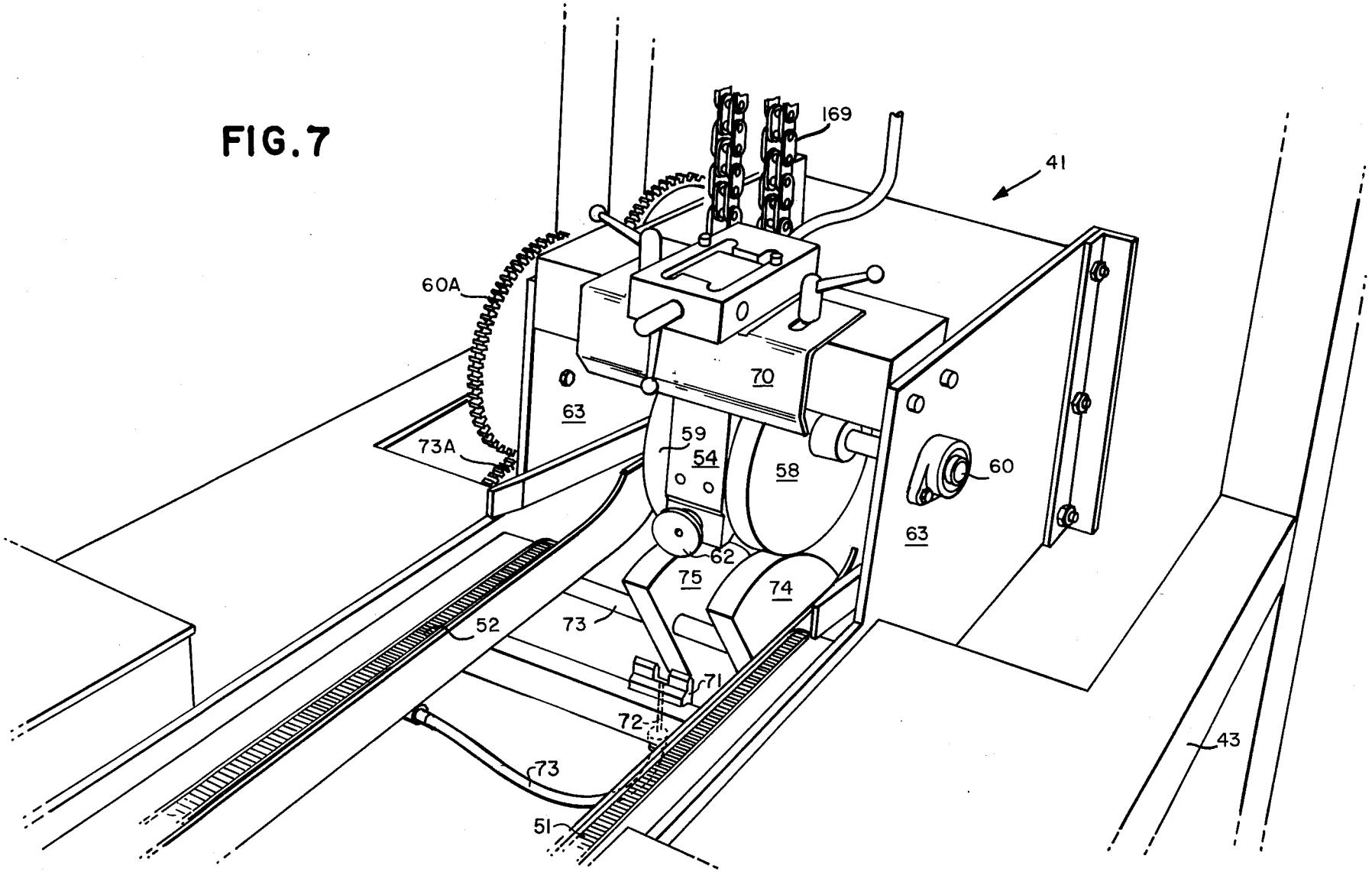
FIG. 7 is an enlarged perspective view of the blank feeding mechanism.

The blank-feeder 41 is shown in enlarged detail in FIG. 7. The blanks are stacked on edge and supported on the side flaps with one end flap 29 and the adjacent gussets extending down between a pair of parallel spaced feed chains 51 and 52. These chains are supported at one end on sprockets 53 with the other end supported on similar sprockets (not shown) with the sprockets 53 each being driven by a one-way clutch 53A such that the chains are jogged or moved intermittently to progress the stack of blanks from left to right in the drawings. The chains are relatively smooth so they can slip past the blanks if the blanks in fact are stacked tightly together but engage the blanks sufficiently to maintain the stack closely against the feeding apparatus. The chains rest against the edges of the side flaps in a manner such that a change in the depth of the tray, i.e., the length of the side flaps or the end flaps within limits, does not alter the capability of the machine for handling those blanks.

Figure 9A:
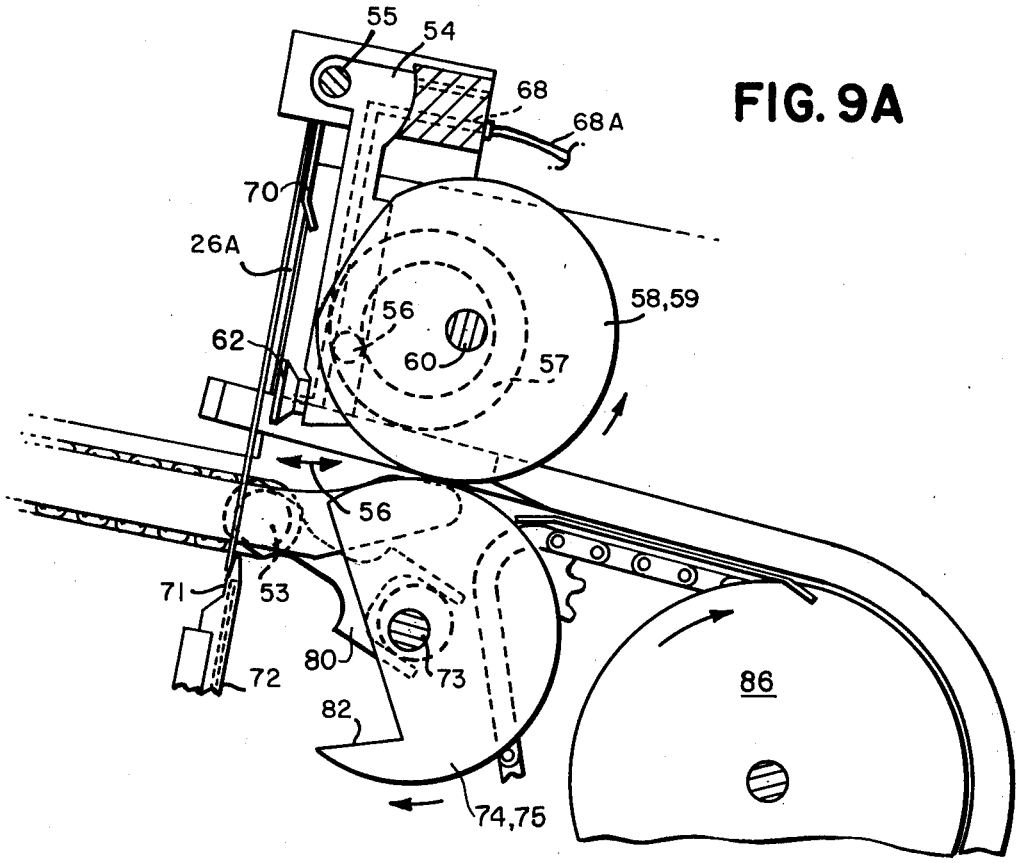
FIGS. 9A, 9B, 9C and 9D are side plan views showing the blank feeding mechanism in a sequence of operations for feeding a blank from the stack.
Figure 9B:
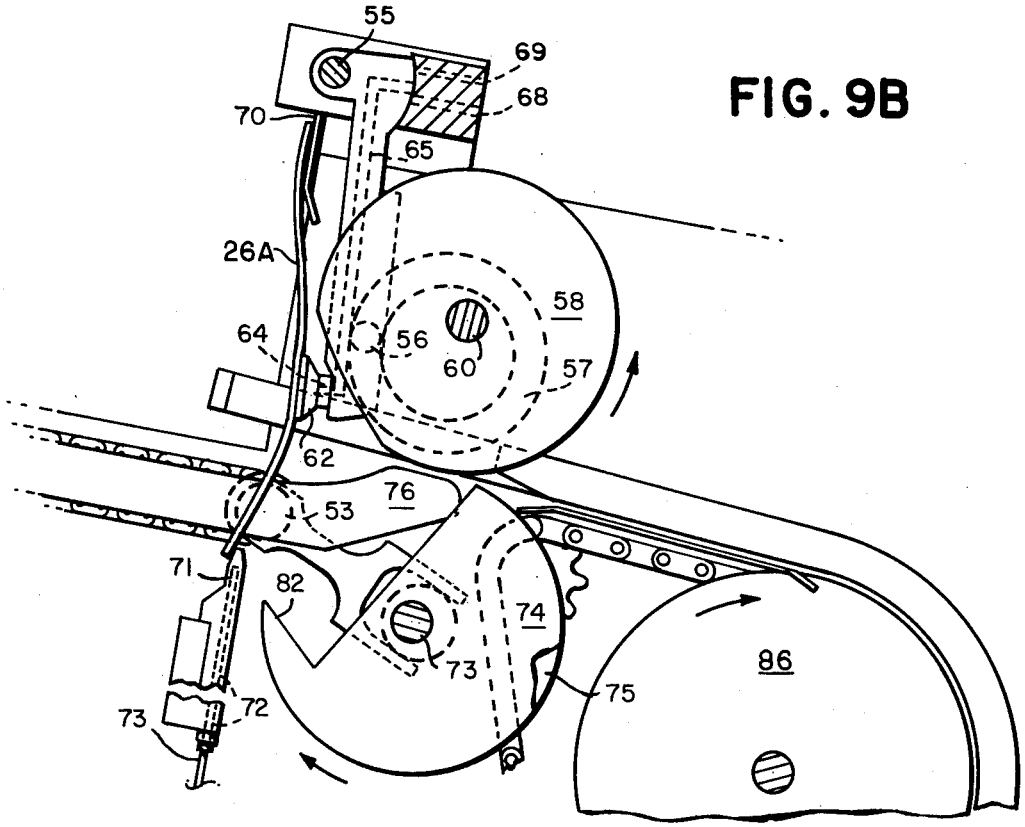

Thus as the chains 51 and 52 through a one-way clutch, drive the end blank down to the position of the singular blank 26A shown in FIG. 9A, the suction arm 54 swings into the first position shown for grasping the end blank to initiate separation from the stack. The arm 54 is pivotally mounted on a horizontal shaft 55 which in turn is journaled in the machine frame. This arm pivots in the direction of the arrow 56 to contact and pull the first tray blank from the stack. For pivoting the arm about the shaft 55, there is fixed to the lower end thereof a lug 56 which extends into a raceway 57 of the grip wheel 58 positioned to one side of the arm. The grip wheel 58 along with a similar wheel 59 spaced to the other side of the arm are fixed to a supporting shaft 60 with the raceway being eccentrically positioned about this shaft. The shaft 60 is journaled in the frame end plates 63 (FIG. 7) with a power driven gear 60A fixed to the shaft end extending past the adjacent end frame. Thus as the grip wheels are rotated, the feed arm 54 is pivoted through approximately a 15° angle.

Fixed to the bottom end of the feed arm facing the tray blanks is a suction cup 62 having a central passage 64 connecting with an internal air passage 65 in the arm. As shown in FIGS. 9A–9D, this internal passage 65 opens at the upper end of the arm to an arcuate face 66 which closely fits against a complimentary arcuate face in a manifold member 67. Passing through this manifold member is a vacuum passage 68 and an opening 69 to atmosphere. The vacuum passage 68 is connected to a suitable vacuum supply through the tube 68A such that when the arm is in the position shown in FIG. 9A a vacuum is drawn within the suction cup 62 so as to attach the suction cup and arm to the first tray blank of the stack. Thus with rotation of the grip wheel 58 in the direction of the arrows, i.e., counterclockwise, the first blank is pulled to the position illustrated in FIG. 9B. At this point the upper end of the blank is firmly pressed against an upper stop 70 due to stack pressure and the lower end is held against the lower stop 71. The lower stop 71 includes a center air passage 72 through which air from a supply hose 73 is blown for a purpose to be explained later. With further rotation of the grip wheel to the position illustrated in FIG. 9B, the blank is bent at the middle in an arcuate shape such that the lower end will move upward slightly and spring past the lower stop 71 to the position shown in FIG. 9C.

Because of the relatively quick movement of the first blank in this manner, there will be created between that blank and the next adjacent blank a partial vacuum as the adjacent blanks are sprung apart with the arcuate bending of the end blank. To relieve this vacuum, compressed air fed through the passage 72 in the stop 71 is directed between the blanks to relieve the vacuum and permit the blanks to separate with ease. Thereafter the end blank 26A is in position for feeding to the conveyor 50.

As the grip wheels 58 and 59 are driven so also are the lower feed wheels 74 and 75 fixed to the shaft 73 driven by the gear 73A (FIG. 7). As the grip wheels 58 and 59 continue to turn to pivot the feed arm 54 to the extreme second position away from the blank stack (FIG. 9D), the vacuum passage 65 moves out of communication with the vacuum tube 68 and begins to communicate with the atmosphere through the passage 69 to release the vacuum attraction between the suction cup 62 and the blank and permit the blank to begin moving freely while riding up the arcuate surface of the parallel guides 76 positioned inside and adjacent to the feed chains 51 and 52. The same shaft 73 that drives the wheels 74 and 75 rotates also an eccentric cam 79 fixed thereto which rotates in an oscillatory motion a yoke 80 about a shaft 81. The shaft 81 is drivingly connected to the one-way clutch 53A which in turn are each in driving engagement with one of the sprockets 53 supporting the drive chains 51 and 52. Thus the drive chains are advanced periodically as the shaft 73 turns.

Figure 9C:
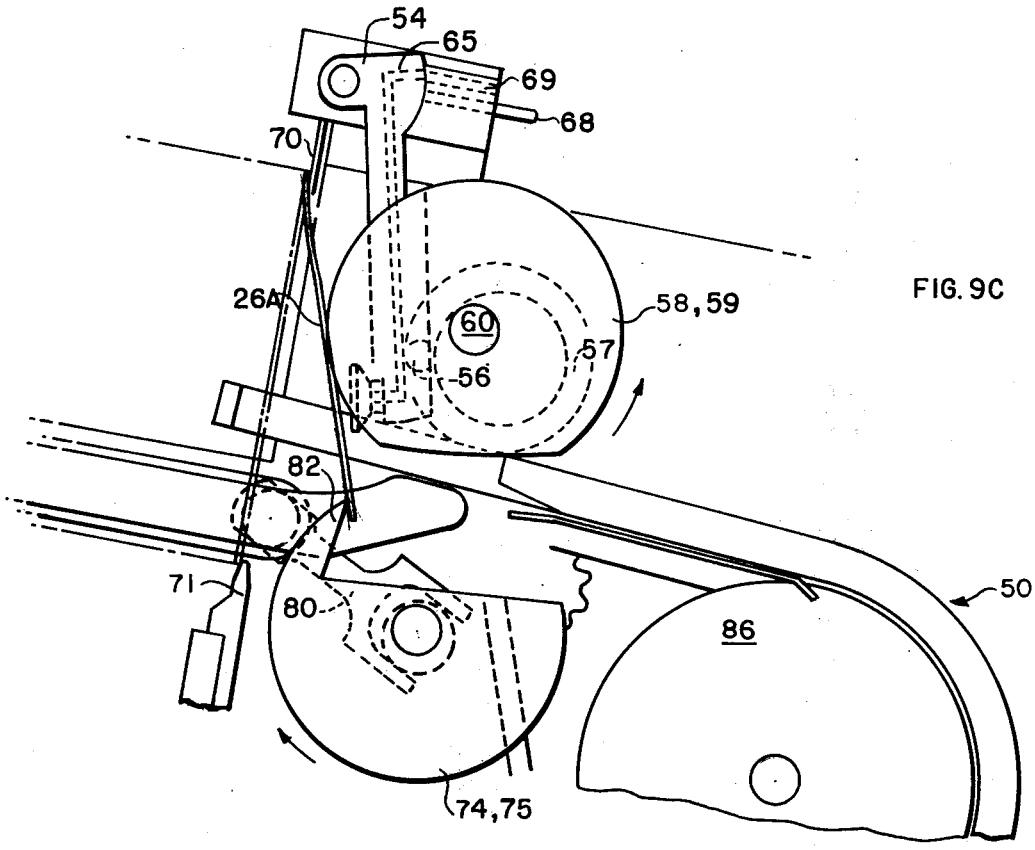
Figure 9D:
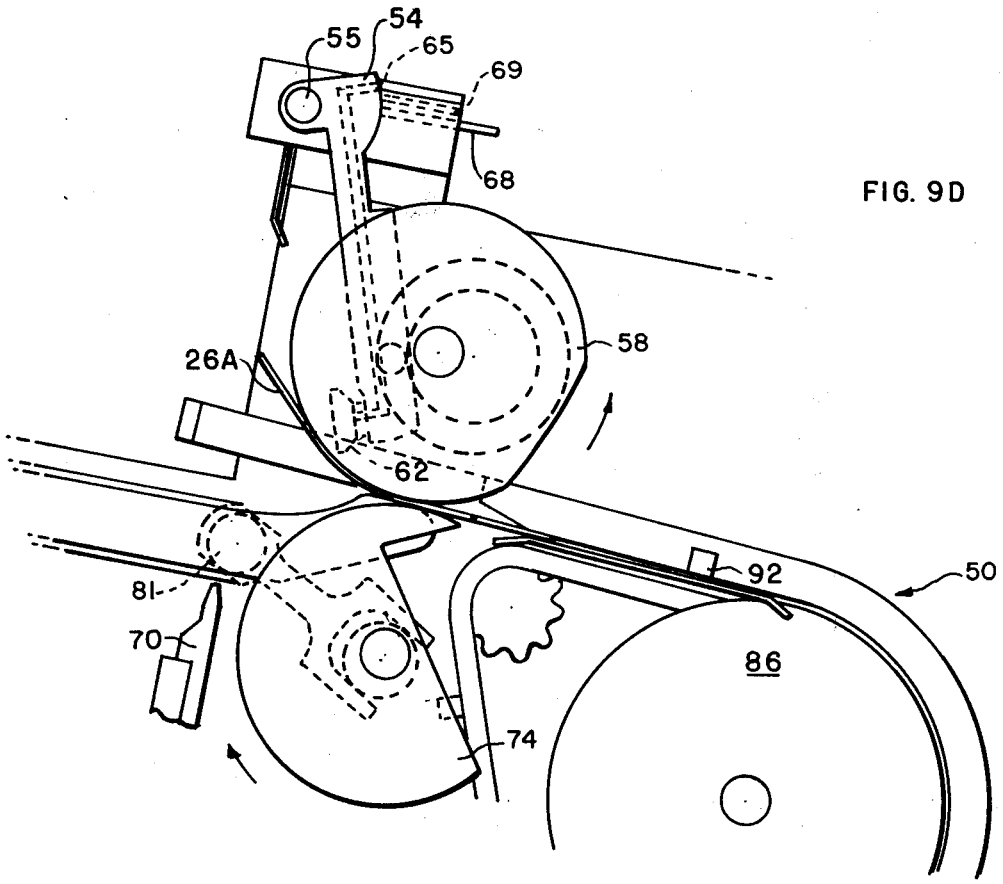

The feed wheels 74 and 75 include a cutout portion forming a knife edge 82 which as shown in FIG. 9C catches the lower end panel of the tray blank fixed to the feed arm 54 and with further rotation of the wheels moves it towards the horizontal position shown in FIG. 9D. At the same time the cutout area of the grip wheels 58 and 59 now rotates away from the blank such that the normal surfaces of these wheels press against the blank as it rides on the adjacent feed wheels 74 and 75 to initiate movement of the blank along a line tangential to the conveyor 50.

As shown in FIGS. 8, 10, 11 and 12, the conveyor 50 includes a pair of chains 84 and 85 which are each threaded around a set of sprockets 86, 87, 88 and 89, respectively. The shaft supporting the sprocket 89 is power-driven through a sprocket 90 by the chain 90A (FIG. 5). The purpose of the conveyor is to receive the blank, index or position the blank so that it will be in phase with the subsequent operations of the forming apparatus, transport the blank through the glue station, and thereafter deliver it to the forming station.

For transporting the blanks, the chain includes a plurality of spaced lugs 92 and 94 on the chains 84 and 85, respectively. These lugs are located side by side on the respective chains but are spaced from each other on the individual chains by a length slightly exceeding the overall length of the blank to include both the bottom panel and the end flaps. The chains are positioned such that the lugs ride against the edges of the side flaps to propel the blank forward as it rides on the guides 95 in parallel spaced relationship with the chains.

Figure 13:
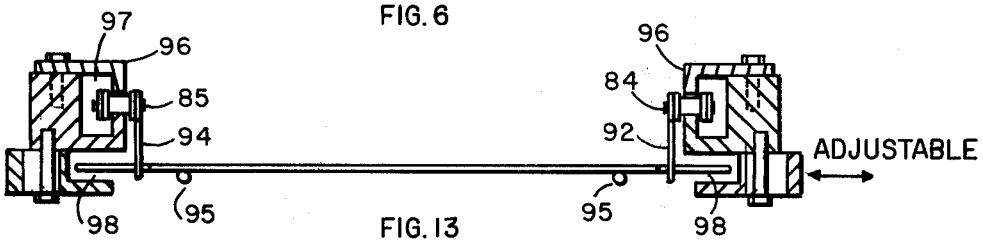
FIG. 13 is a section view of the blank feeding chain and guide assembly.

As shown in FIG. 13 the chains ride in channel guides 96 having a passage 97 therethrough for the chain and a channel 98 therethrough through which the side panels of the blanks pass. Since the lugs are spaced from each other on each chain a predetermined distance and since the rotation of the drive sprocket and therefore the driving of the chain is timed with the operation of the apparatus, the blank is thereby indexed to put it in phase with the subsequent operations. The blank will bend around corners and ride between the outside guides 95 and various inside guides 99 as it changes direction after leaving the blank feeding station for passage through the glue station.

Figure 10:
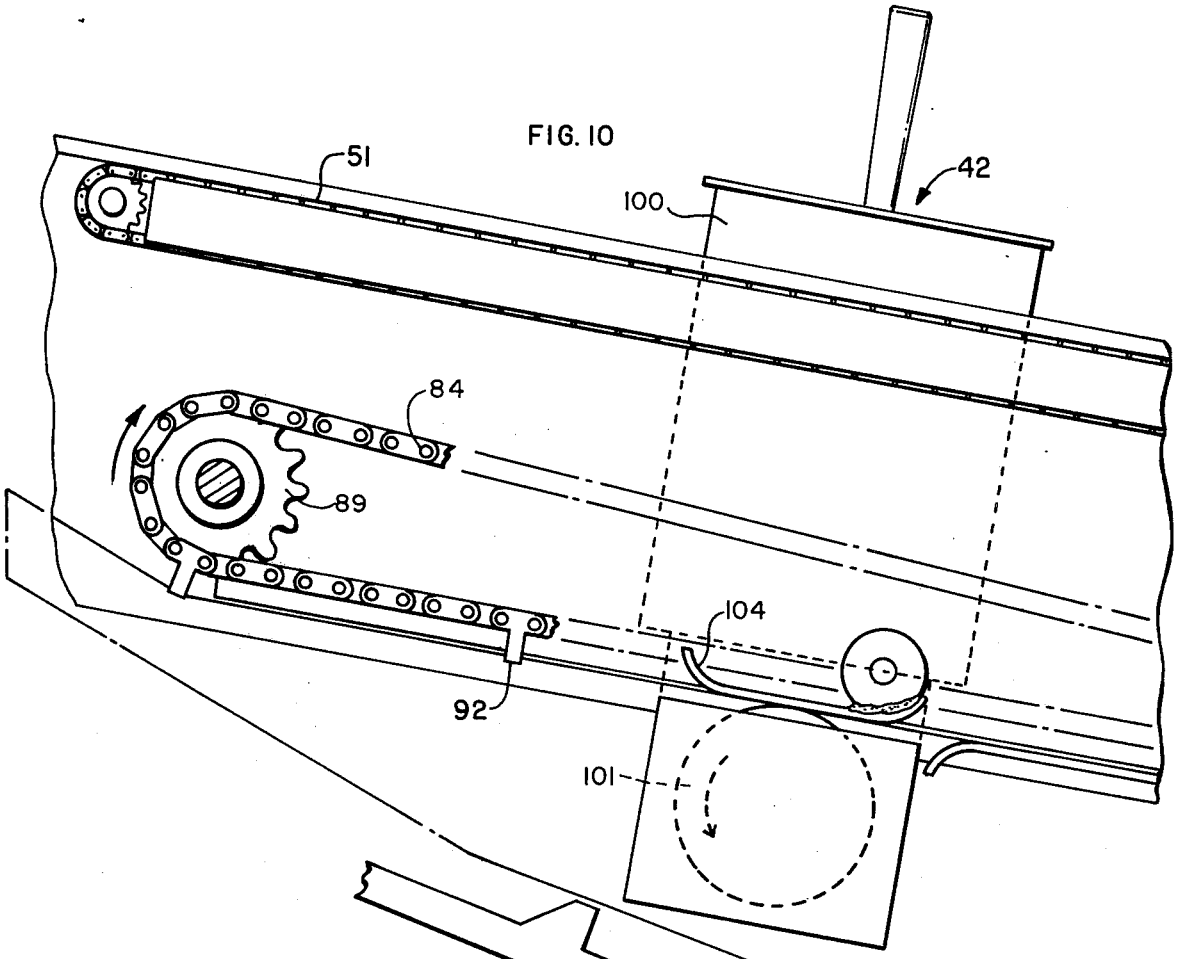
FIG. 10 is a side end view of the glue application station.
Figure 14:
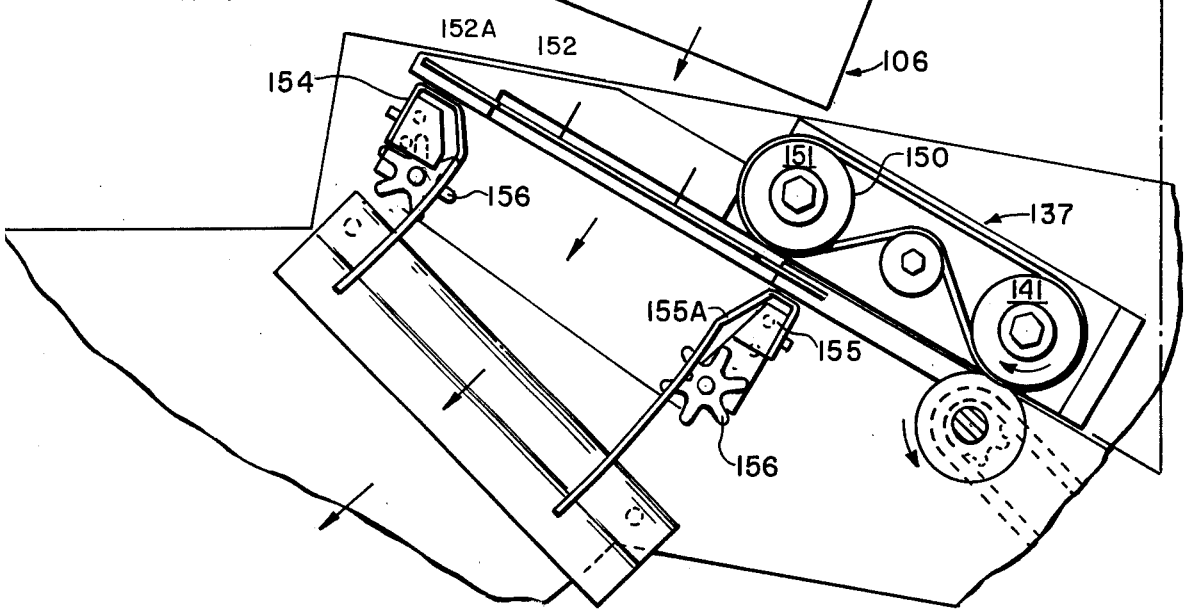
FIG. 14 is a side view of the blank folding die assembly.
Figure 16:
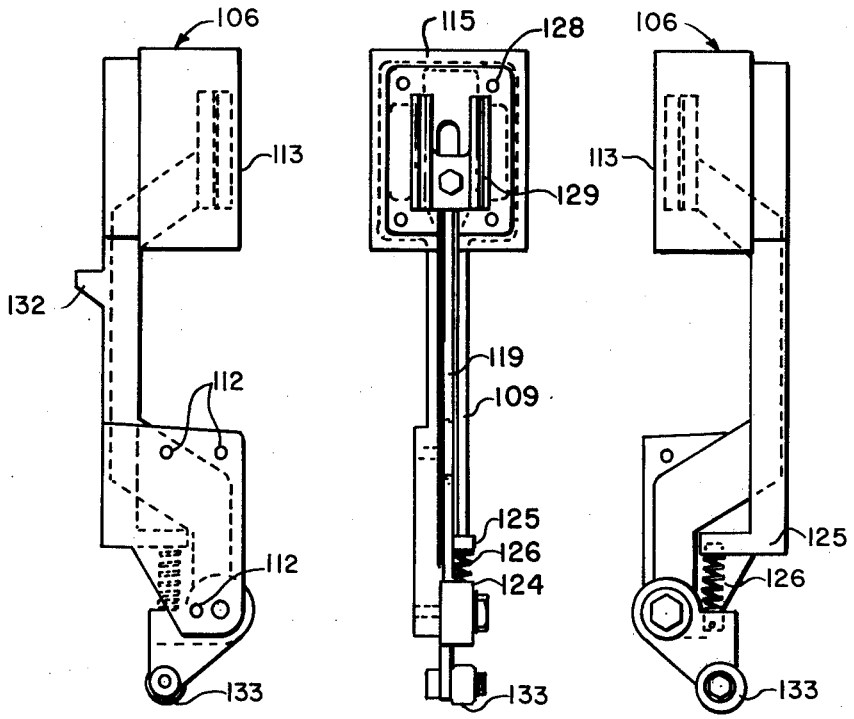
FIG. 16 shows various views of the tray forming mandrel.

The glue station is shown diagramatically in FIG. 10 and can be any of several available types which usually comprise a glue reservoir 100 which preferably is heated to supply the glue to a power driven glue wheel 101. The glue wheel in this embodiment is partially submerged in a pool of glue and includes a series of indentations on the outer periphery. These indentations are positioned to correspond to the desired pattern 38 of glue (see FIG. 4) which is preferred on the corner gussets to hold the tray in the formed attitude. Thus as the glue wheel rotates in the counterclockwise direction glue is picked up on the surface thereof. As the wheel passes by a scraper contacting the wheel surface, all the glue is removed except that deposited in the indentations. As the blank passes between the glue wheel and a guide rod 104, the blank is pressed against the wheel and driven forward in timed relationship with the rotation of the wheel. The glue in the indentations sticks to the blank and is thus deposited on the gusset corners in the pattern of the indentations. The glue is the hot-melt type that sets in a few seconds such that on the subsequent forming operation when the corner gussets are folded and the surfaces come together and are held for a few seconds, the glue will cool and set sufficiently to thereafter hold those surfaces together. Several common types of glue suitable for this purpose are commercially available.

After passage through the glue station 42 (FIG. 5) the blank is transported further by the conveyor 50 in a manner such that the glue surfaces are not contacted. With the timed positioning of the blank by the conveyor and now the completion of the glue deposition, the blank is ready for introduction into the forming station. As shown in FIGS. 1 and 5, the forming station 45 and the holding station 46 are encompassed in a single rotating forming assembly 103 including a hub 105 about which are supported a plurality of forming mandrel assemblies 106 of which there are 18 in the embodiment described. The hub 105 is driven through a gear box 107 by means of a chain drive 108. This forming assembly is rotated at a relatively slow speed, say 10–20 rpm in the embodiment shown and serves to receive the blank and pass it through a die assembly to fold the side and end panels and the corner gussets, and thereafter hold the folded tray for a sufficient time period to enable the glue to set and maintain the tray integrity. The tray is then stripped from the mandrel and positioned in a manner such that the outfeed mechanism can deliver the formed tray from the mandrel assembly. The hub assembly 105 is supported on a shaft 110 journaled on the apparatus frame. The gear box 107 is mounted on the frame to one side of the hub assembly.

A mandrel assembly for forming the tray from the blank is shown in FIGS. 1, 5, 16 and 17 and comprises a mandrel arm 108 having a base section 109 which is bolted to the hub 105 by means of suitable bolts passing through the holes 112 thereof. The opposite or extending end of the mandrel assembly includes a mandrel head 113 having a planar surface 114 to which can be mounted a forming head 115. The forming head is held on the mandrel by a plurality of bolts 115A passing through aligned openings in the mandrel head and forming head.

Within the mandrel arm 108 is a slot 116 which extends into a central opening 117 of the mandrel head. Into this slot is fit the stripper assembly 118 comprising a stripper head 118A mounted at the end of a stripper arm 119. At the base of the stripper arm is a hub 120 having an opening 121 therethrough with a similar opening 122 in the base 109 of the mandrel. A land 124 on the hub of the stripper assembly extends in spaced parallel relationship to a flange 125 on the mandrel arm. The land and flange each include a recess for receiving opposite ends of a spring 126 which biases the stripper assembly relative to the mandrel assembly to the position illustrated in FIG. 16.

The stripper head extends through a slot 127 in the forming head 114A and includes a stripper pad 128 which interfits also within the recess of the forming head. The pad preferably includes a resilient surface 129 which will contact the formed tray in a manner to be described. The back surface 131 of the mandrel head 111 is also planar and includes a post 132.

The general functioning of the mandrel assembly is as follows. The blank is positioned on the face 114A of the mandrel form by means of the mandrel passing through the die chamber where the blank has been positioned. The form fits the bottom panel 28 of the tray with the outer edges adjacent the face 114A closely corresponding to the fold lines 31 and 32 of the tray blank. By subsequent force in timed relationship, the end flaps, the corner gussets and the side flaps are bent along the adjacent surfaces 134 and 135 of the forming head so that the tray is in the formed configuration. By holding the tray in this position closely outlining the forming head for a few seconds, the glue is permitted to set and thereafter maintain the tray as formed. The folding of the blank around the forming head is preferably effected by a relative motion between the mandrel assembly and the forming head and members extending around the rotary path of the forming head which form a die chamger so as to cam the various side and end flaps of the blank to the correct configuration.

Figure 15:
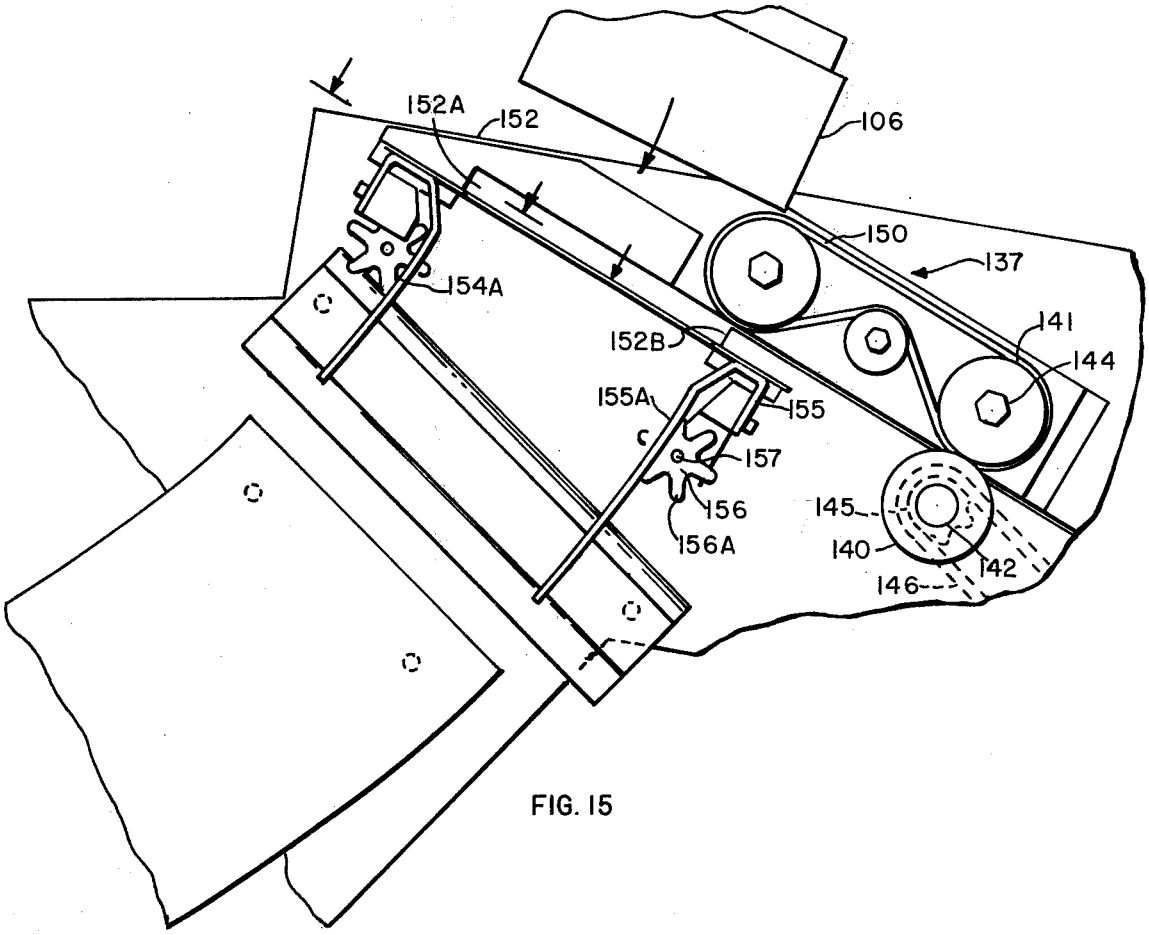
FIG. 15 is another view of the blank being fed into the tray forming station.

Thus as illustrated in FIGS. 5 and 15, the conveyor 50 delivers the tray blank in timed sequence to a feed roller assembly 137 positioned between the end of the conveyor and the die chamber. The feed roller assembly includes a pair of resilient rollers 140 and 141 mounted on spaced parallel shafts 142 and 144 on each side of the path of the blank. A sprocket 145 is fixed to the shaft 142 and is driven by a drive chain 146. A drive belt 150 extends from the periphery of the roller 141 and around a third roller 151 spaced further along the path of the blank as it proceeds to the die chamber position.

Thus the blank is propelled to the end of the conveyor 50 by the pushing action of the lugs 84 and 85 which in turn accelerate the blank away from the pushing lug and propel it into alignment with an oncoming mandrel assembly 106. The mandrel assemblies are rotating with the hub in the clockwise direction. As the blank leaves the grasping action of the adjacent rollers 140 and 141, it is propelled forward by the action of belt 150 around pulley 151 until it encounters a fender 152 which stops the blank with a surface **152*a* which is in line with each side flap leading edge. The distance between the fender surface 152*a* and a back stop 152*b* is slightly longer than the side flap. Thus the blank stops abruptly upon striking the fender 152 with any rebound tendency prevented by the action of the belt 150 and the back stop 152*b*. The piece 152 also acts as a side guide such that the tray blank is locked in position fore, aft and sideways. While still in the locked position the blank settles onto the guides or end forming pieces 154 and 155, in line with the mandrel. The guide 154 is split to accommodate passage of the mandrel arm 108 therebetween. The blank rests momentarily on the forming pieces 154 and 155** now centered for the approaching mandrel forming head.

Figure 19:
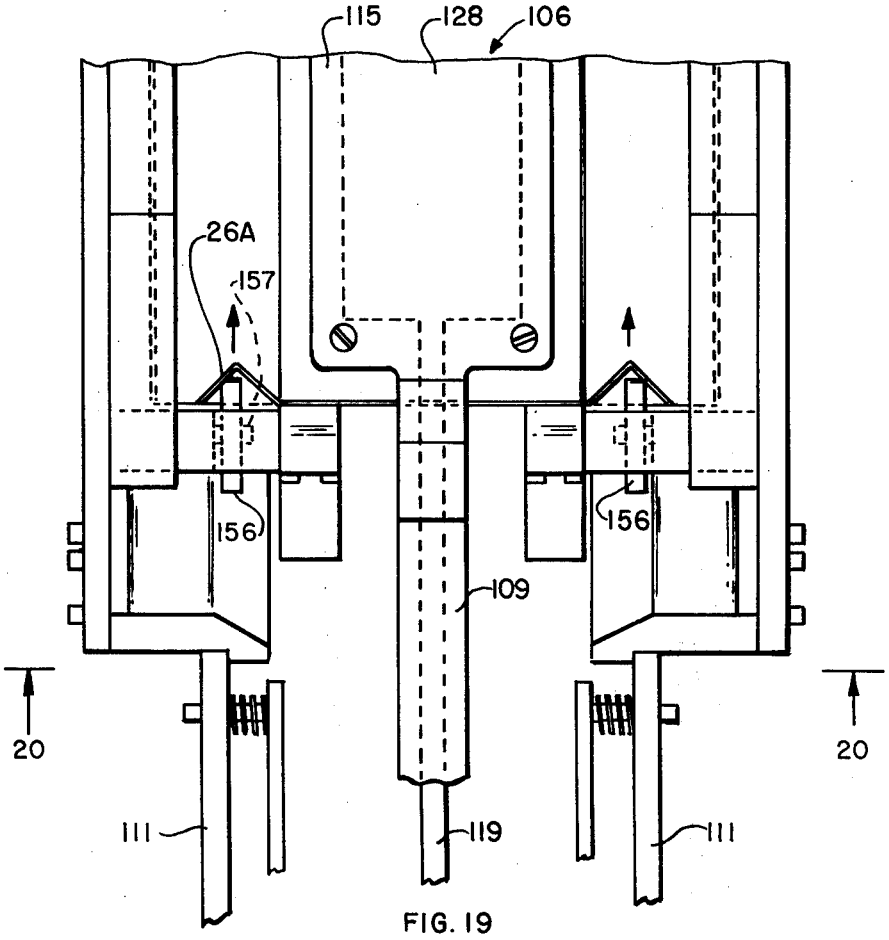
Figure 20:
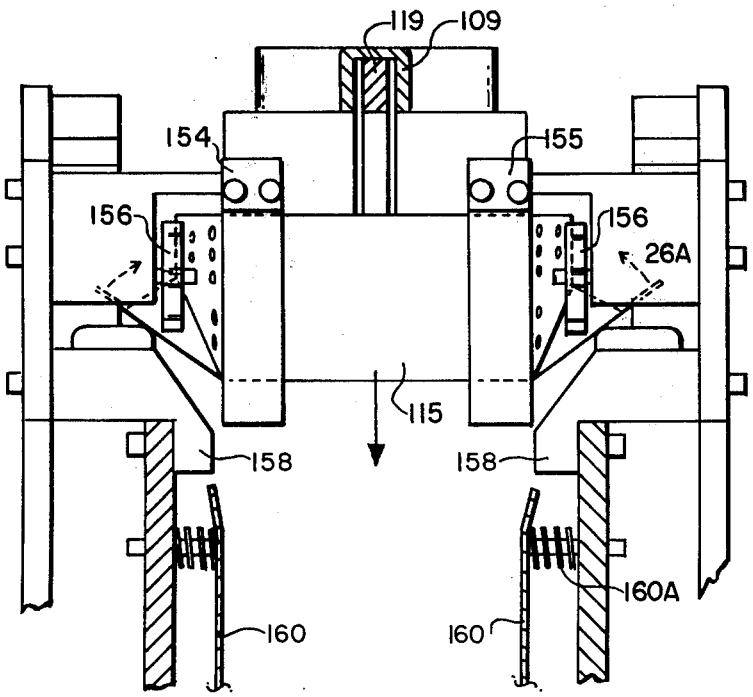

Referring now to FIG. 18, the approaching forming head now moves into contact with the blank and pushes it between the inner guide or fender surfaces 154A and 155A of the guides 154 and 155 to initiate bending of the end flaps along the fold lines 31 to a position adjacent the opposite faces 134 of the forming head 115. These fenders are configured to gradually initiate the bending of the blank and assure against tearing of the blank material. Continued movement of the blank between the fenders results in the corner gussets encountering the star wheels 156 positioned to each side of the blank in alignment with the path of the corner gussets (FIGS. 19 and 20). These star wheels are mounted for free rotation about a shaft 157 such that as the gusset passes it will encounter the projecting arm 156A which at that time extends into the path of the blank. The contact of the blank will cause an indexing of the star wheel such that the trailing arm will swing around and push on the gusset at the fold line 37 to influence the gusset to fold inward at the gusset fold line. A frictional engagement between each star wheel and the shaft 157 helps to prevent absolute free turning while permitting limited rotation when encountered by the blank.

Figure 17:
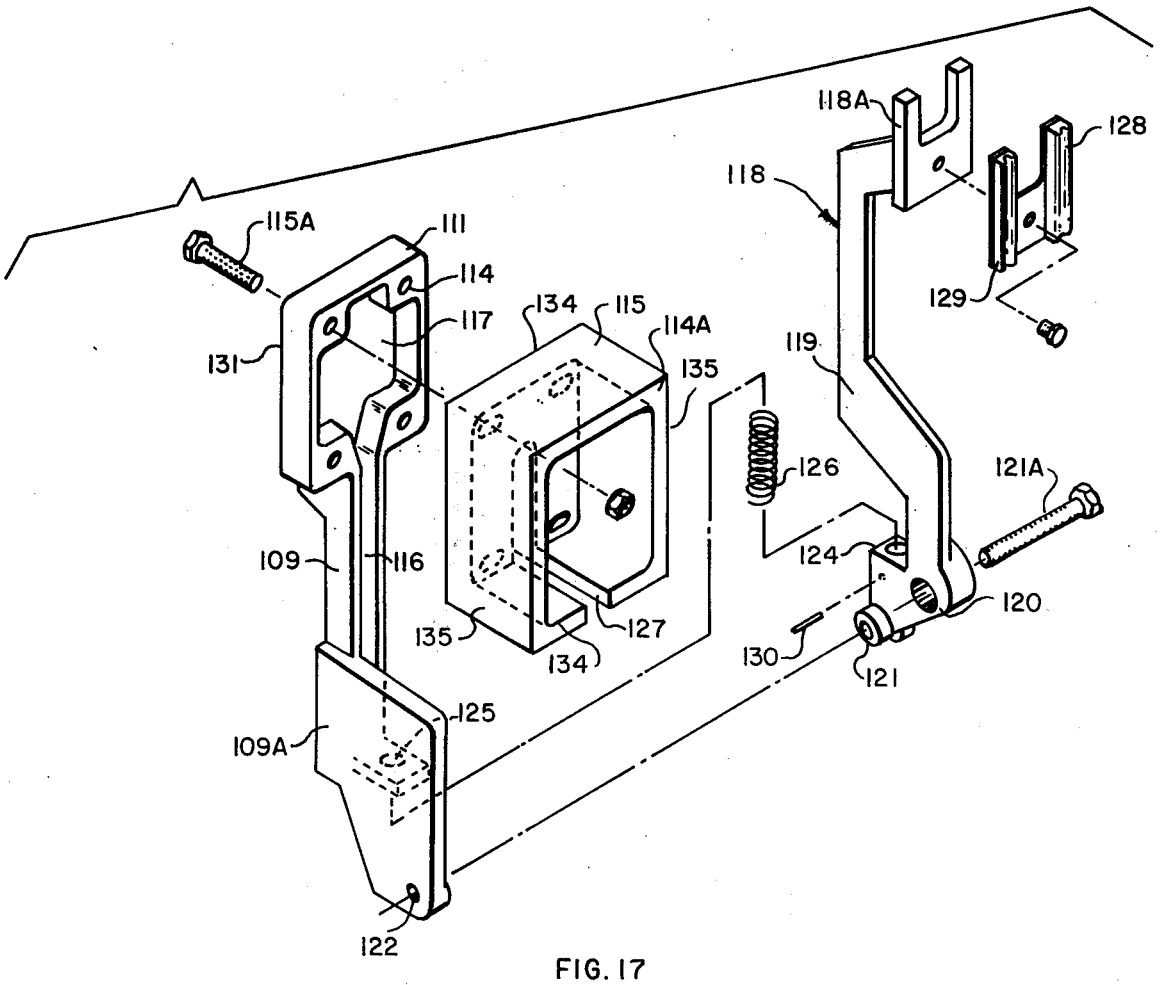
FIG. 17 is an exploded view of the tray forming mandrel.

With the corner gussets being influenced to bend inward at the fold 37, the mandrel assembly in continuing the rotation with the forming assembly moves further to bring the side flaps 30 into contact with a pair of spaced camming members 158 positioned close to the path of the forming head surface 135 as shown in FIGS. 17 and 21. These members force each side panel to fold about the fold line 32 to a position adjacent the surface 135 of the forming head completing the folding of the tray about the head. Thereafter the mandrel assembly continues rotation between a pair of guides or spring loaded fenders 160 positioned on each side of the path of the forming head holding the side panels of the tray in place as the mandrel assembly moves from the station 45. Thus the holding station 46 includes these fenders which permit the sliding of the tray therethrough as it rides on the head of the mandrel. The traversing of the tray past the fenders takes a sufficient time to permit the glue to set sufficiently to hold the corner gussets and side panels in glued relationship.

Figure 22:
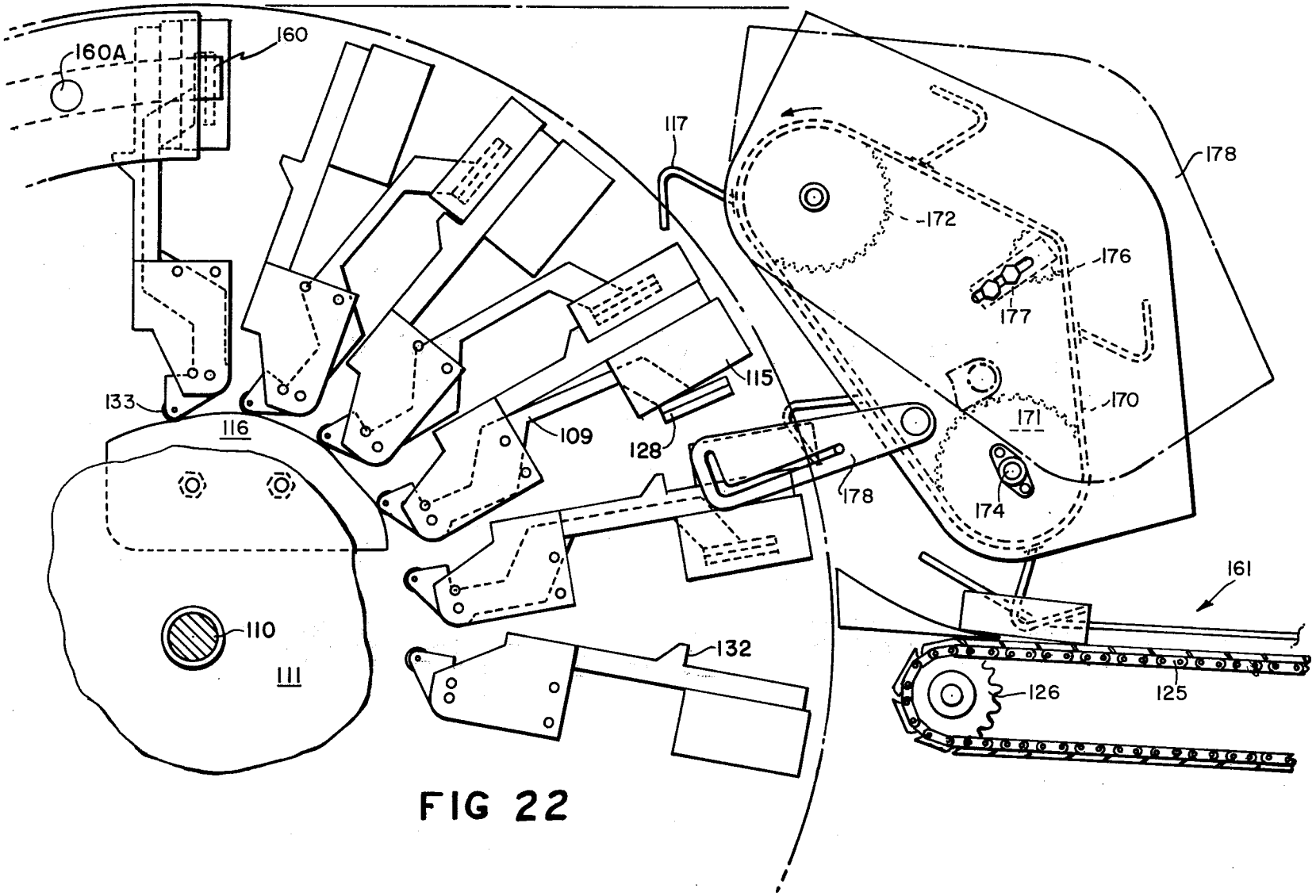
FIG. 22 is a side plan view of the tray ejection station.

Thereafter as the mandrel assembly enters the stripping station 47 the stripper arm roller 133 initiates contact with a cam member 116 (FIG. 22) to force the stripper arm to pivot about the bolt 121A extending through the opening 121 while overcoming the force of the spring 126. With further riding of the roller up over the cam surface the stripper arm 119 is pivoted to bring the stripper pad 128 into engagement with the inside of the tray bottom panel 28 and initiate movement of the tray off of the forming head. The tray is held into engagement with the stripper pad by the frictional drag between the tray and the fenders 160. Continued forward movement of the pad and stripper assembly brings the bottom 28 of the tray into contact with the rear surface 131 of the next adjacent mandrel head to clamp the tray in that position during further rotation of the mandrel assembly to the outfeed station 48. In this position the tray is held in preparation for removal from the mandrel assembly.

The outfeed station 48 includes means to remove the tray from the mandrel assembly and place it on an outfeed conveyor 161. The outfeed conveyor comprises a conveyor chain 125 supported about a pair of spaced sprockets 164 and 165 (FIG. 5) supported on the shaft 166 and 167 journaled on the frame. The sprocket 166 is driven by a sprocket 168 (FIG. 5) linked with a drive chain 169. The outfeed conveyor thus includes a horizontally extending segment for receiving and transporting the formed trays.

For removing each tray from the mandrel assembly, an ejector chain 170 is threaded about a pair of sprockets 171 and 172 spaced from the mandrel assembly and mounted for rotation about the shafts 174 and 175 in the plane of the mandrel assembly. A third sprocket 176 mounted on a bracket 177 serves as a takeup means for tightening the chain. The shafts 174, 175 and the bracket 177 are fixed to a pair of side plates 178 with one plate positioned on each side of the ejector station. The shaft 175 is power driven in timed relationship with the mandrels.

Fixed to the chain 170 are a plurality of hooks 117 which contact the formed tray as each mandrel assembly passes through the outfeed station. The hooks encounter the tray through the trailing open side and as contact is made, the stripper assembly rides off the cam member 116 to permit that assembly to withdraw from contact with the tray. As the chain 170 moves further from the path of the mandrel assembly, the hook 117 pulls the tray away from that assembly. Under the influence of the hook, the tray slides along a bottom guide 179 until it comes into contact with the conveyor 161. The hook then lifts away as the chain 170 passes around the sprocket 171 to leave the tray resting freely on the conveyor.

As shown primarily FIGS. 1 and 5, the forming apparatus 25 is supported on a suitable frame 43, which in the embodiment illustrated comprises an end section 180, two center posts 181 and two end posts 182. Suitable leveling feet 184 are provided also. The conveyor 50 is supported primarily between the cross supports 185 extending between the end section and the center posts. The mandrel assembly is mounted on the cross supports 186 extending between the center and end posts. A lower horizontal frame 187 extends near ground level and supports a main drive motor 188 and the vacuum pump 189. Suitable drive chains extend from the drive motor to the various components heretofore described. By using drive chains and sprockets to power the components, the proper timing sequence is maintained between the various stations of the forming apparatus.

The invention claims:

1. A tray forming apparatus for forming a tray from a blank having a bottom panel and side forming panels with a fold line therebetween, said apparatus comprising, in combination:

a plurality of mandrel assemblies having a forming head about which the blank can be folded to form the tray;

a die assembly to cause folding of the blank about the forming head with passage of each mandrel assembly therethrough;

a stripping head mounted in each mandrel assembly for movement relative to the forming head to remove the formed tray from the forming head;

means to position a blank onto each forming head;

means to effect relative movement between the die assembly and each forming head to move the forming heads through the die assembly in succession to form the blank about each forming head;

means to cause movement of the stripping head relative to the forming head to strip the formed tray therefrom and clamp the formed tray between the stripping head and the next adjacent mandrel assembly; and means to remove the formed tray from the mandrel assembly.

2. A tray forming apparatus for forming a tray as defined in claim 1 wherein said plurality of mandrel assemblies are mounted on a rotatable hub for passage through a stationary die assembly.

3. A tray forming apparatus for forming a tray as defined in claim 2 wherein said die assembly comprises a plurality of guides positioned along the path through which the mandrel assemblies pass during rotation of the hub assembly.

4. A tray forming apparatus for forming a tray as defined in claim 3 wherein said means to position a blank onto the forming head comprises guide means positioned along the path of the forming head for receiving the blank and holding it until the next approaching forming head passes through the guide means.

5. A tray forming apparatus for forming a tray from a blank having a bottom panel and a plurality of side panels attached thereto with fold lines therebetween and having gussets joining adjacent side panels, said apparatus comprising, in combination:

means for holding a stack of tray blanks;

a plurality of mandrel assemblies each having a forming head about which the blank is folded to form the tray;

a die assembly which by passage of each mandrel assembly therethrough will fold the blanks about the forming head, said die assembly including means to influence the gussets to cause folding in a predetermined manner about the gusset fold line;

means to feed the tray blanks in single file order from the holding means with one blank to each mandrel assembly;

means to effect relative movement between the die assembly and the forming head to fold the blank about the forming head said means including a hub mounted for rotation about an axis and holding said mandrel assemblies for passage through the die assembly;

means to influence the folding of the gussets inward comprising a rotatable member having fingers thereon which contact the gusset as the blank is moved thereby on the forming head to push the gusset inward at the fold line;

means to effect relative movement between the formed tray and the forming head to remove the tray therefrom including a stripping head mounted for movement relative to the forming head to strip the formed tray from the forming head; and means to remove the formed tray from the mandrel assembly.

6. A tray forming apparatus for forming a tray as defined in claim 5 wherein said rotatable member includes fingers which are contacted by the blank as it is moved therepast to rotate the member and cause an adjacent finger thereon to contact and push inward on the gusset.

7. A tray forming apparatus for forming a tray as defined in claim 6 including means positioned between the means to feed the tray blanks in single file order and the mandrel assembly for depositing glue on the gussets.

8. A tray forming apparatus for forming a tray as defined in claim 7 wherein said die assembly includes a plurality of guides positioned along the path through which the mandrel assemblies pass during rotation of the hub assembly, which guides hold the tray blank in the folded position about the forming head.

9. A tray forming apparatus for forming a tray from a blank having a bottom panel and a plurality of side panels attached therethrough with fold lines therebetween and having gussets joining adjacent side panels, said apparatus comprising in combination:

a mandrel assembly having a forming head about which the blank is folded to form the tray;

a die assembly which by passage of the mandrel assembly therethrough will fold the blank about the forming head, said die assembly including means to influence the gussets to cause folding inwardly about the gusset fold line including a rotatable member having a plurality of fingers which are positioned such that one will be contacted by the blank as it moves thereby to rotate the member and cause another finger thereon to contact and push inward on the gusset;

a stripping head mounted in the mandrel assembly for movement relative to the forming head to strip the formed tray from the forming head;

means to position a blank onto the forming head;

means to effect relative movement between the die assembly and the forming head to fold the blank about the forming head;

means to cause movement of the stripping head relative to the forming head to strip the formed tray therefrom; and means to remove the formed tray from the mandrel assembly.

10. A tray forming apparatus for forming a tray as defined in claim 9 comprising in combination a plurality of mandrel assemblies mounted for movement in succession through the die assembly with means for moving the mandrel assemblies successively through the die assembly.

11. A tray forming apparatus for forming a tray as defined in claim 10 including rotatable hub means for mounting the mandrel assemblies for rotation through a stationary die assembly.

* * * * *